US007572993B2

(12) United States Patent
Chen et al.

(10) Patent No.: US 7,572,993 B2
(45) Date of Patent: Aug. 11, 2009

(54) DUSTPROOF COVER AND ELECTRONIC APPARATUS

(75) Inventors: Wei-Yu Chen, Taipei (TW); Kuei-Fang Chung, Taipei (TW)

(73) Assignee: Inventec Corporation, Taipei (TW)

( * ) Notice: Subject to any disclaimer, the term of this patent is extended or adjusted under 35 U.S.C. 154(b) by 204 days.

(21) Appl. No.: 11/649,851

(22) Filed: Jan. 5, 2007

(65) Prior Publication Data

US 2007/0284229 A1 Dec. 13, 2007

(30) Foreign Application Priority Data

Jun. 9, 2006 (TW) ..... 95210145 U

(51) Int. Cl.
*H01R 13/44* (2006.01)

(52) U.S. Cl. ..... 200/302.1; 439/135

(58) Field of Classification Search ..... 200/43.16, 200/43.18–43.19, 203.1; 439/135–150, 491, 439/944, 923, 676, 133; 341/22–23
See application file for complete search history.

(56) References Cited

U.S. PATENT DOCUMENTS 5,017,148 A * 5/1991 Buckshaw ..... 439/148
5,582,180 A * 12/1996 Manset et al. ..... 600/508
6,093,899 A * 7/2000 Takano et al. ..... 200/302.1
6,454,581 B1 * 9/2002 Ribeiro ..... 439/148
2007/0293066 A1 * 12/2007 Hynds et al. ..... 439/135

* cited by examiner

*Primary Examiner*—Renee S Luebke
*Assistant Examiner*—Sean Kayes
(74) *Attorney, Agent, or Firm*—Birch, Stewart, Kolasch & Birch, LLP

(57) ABSTRACT

A dustproof cover is used in conjunction with a casing, which at least has a first opening, a second opening, a first engaging part and a first connecting part. The dustproof cover includes a first dustproof part, a second dustproof part, a second engaging part and a second connecting part. The first dustproof part corresponds to the first opening of the casing. The second dustproof part corresponds to the second opening of the casing. The second engaging part corresponds to the first engaging part of the casing. The second engaging part is located between the first dustproof part and the second dustproof part. The second connecting part is connected with the first connecting part of the casing. The first dustproof part is located between the second engaging part and the second connecting part. In addition, an electronic apparatus including the dustproof cover is also provided.

5 Claims, 7 Drawing Sheets

5

DUSTPROOF COVER AND ELECTRONIC APPARATUS

BACKGROUND OF THE INVENTION

1. Field of Invention

The invention relates to a protection element and an electronic apparatus, and, in particular, to a dustproof cover and an electronic apparatus.

2. Related Art

With the development of technology, a lot of products including, for example, electronic apparatuses, vehicles and home appliances, have been developed to satisfy man's requirements. In order to extend the lifetime of products, various protection elements have been designed to protect specific elements of the products. For example, a dustproof cover is designed to cover a certain part of a product in order to prevent that part from being contaminated by dust and thus damaged.

For example, referring to FIG. 1, a conventional electronic apparatus 1 includes a host 11, a casing 12 and a plurality of dustproof covers 13. The host 11 is disposed in the casing 12 and has a plurality of output/input ports 111 including, for example, earphone jacks, power input terminals or USB slots. The output/input ports 111 are exposed out of the casing 12 through a plurality of openings 121 of the casing 12. In addition, the dustproof covers 13 are disposed outside the casing 12 and cover the output/input ports 111 to protect the output/input ports 111.

However, the number of the dustproof covers 13 has to be increased with the increase of the number of the output/input ports 111. Thus, the cost of the mold of the dustproof cover 13 is increased and the complexity of assembling the product is increased.

In order to overcome the above-mentioned problems, another conventional electronic apparatus including a host, a casing and a dustproof cover is provided. The host is disposed in the casing and has a plurality of output/input ports including, for example, earphone jacks, power input terminals or USB slots. The output/input ports are exposed out of the casing through a plurality of openings of the casing. In addition, the dustproof cover is disposed outside the casing and simultaneously covers the output/input ports. If the user wants to use the earphone jack of the host, he or she has to open the overall dustproof cover to expose the earphone jack for subsequent use. However, when the user opens the overall dustproof cover, other output/input ports are also exposed and thus lack the protection of the dustproof cover. In other words, when the user uses one of the output/input ports, other output/input ports cannot be protected by the dustproof cover. Thus, other output/input ports tend to be contaminated by dust and are thus damaged.

Thus, it is an important subject of the invention to provide a dustproof cover capable of solving the above-mentioned problems, and an electronic apparatus including the dustproof cover.

SUMMARY OF THE INVENTION

In view of the foregoing, the invention is to provide a dustproof cover and an electronic apparatus including the dustproof cover, wherein the dustproof cover can protect a first electronic element module corresponding to a first opening of a casing when a second electronic element module corresponding to a second opening of the casing is being used.

To achieve the above, the invention discloses a dustproof cover used in conjunction with a casing. The casing at least has a first opening, a second opening, a first engaging part and a first connecting part. The dustproof cover includes a first dustproof part, a second dustproof part, a second engaging part and a second connecting part. In this invention, the first dustproof part corresponds to the first opening of the casing; the second dustproof part corresponds to the second opening of the casing; the second engaging part is located between the first dustproof part and the second dustproof part and corresponds to the first engaging part of the casing; and the second connecting part is connected with the first connecting part of the casing. The first dustproof part is located between the second engaging part and the second connecting part.

To achieve the above, the invention also discloses an electronic apparatus including a casing and a dustproof cover. The casing at least has a first opening, a second opening, a first engaging part and a first connecting part. The casing at least has a first opening, a second opening, a first engaging part and a first connecting part. The first dustproof part is corresponding to the first opening of the casing, and the second dustproof part is corresponding to the second opening of the casing. The second engaging part corresponds to the first engaging part of the casing and is located between the first dustproof part and the second dustproof part. The second connecting part is connected to the first connecting part of the casing. The first dustproof part is located between the second engaging part and the second connecting part.

As mentioned above, the dustproof cover and the electronic apparatus of the invention each have the first engaging part corresponding to the second engaging part of the casing. So, when the second engaging part engages with the first engaging part of the casing, the first dustproof part and the second dustproof part may respectively cover the first opening and the second opening of the casing, or the first dustproof part can cover the first opening of the casing, and the second dustproof part can be opened to expose the second opening of the casing. In other words, the dustproof cover of the invention may keep the first opening and the second opening shielded, or keep the first opening shielded and leave the second opening exposed. Thus, when the user does not use any electronic element modules, the dustproof cover can simultaneously protect the first opening of the casing corresponding to the first electronic element module and the second electronic element module corresponding to the second opening. In addition, when the user uses the second electronic element module corresponding to the second opening of the casing, the dustproof cover may also protect the first electronic element module corresponding to the first opening of the casing and thus extend the lifetime of the electronic product.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
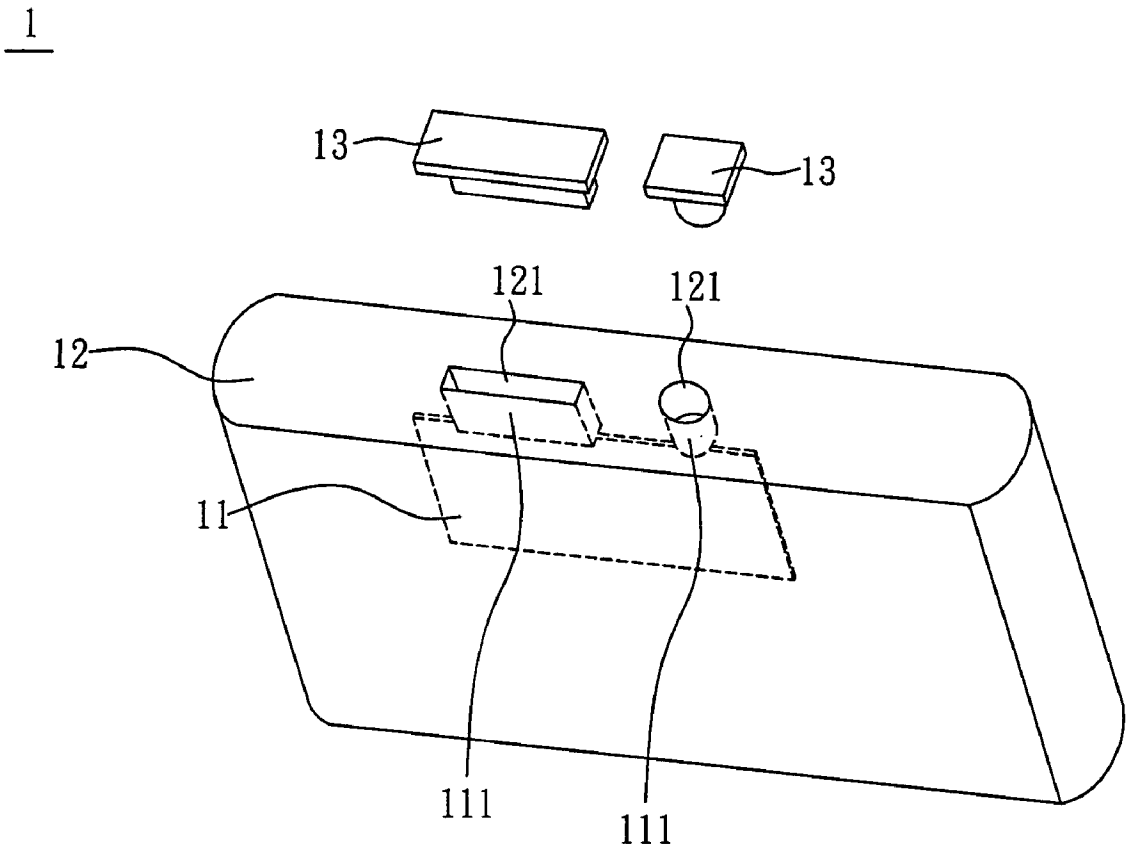
FIG. 1(PRIOR ART)
FIG. 1 is a schematic illustration showing a partial perspective view of a conventional electronic apparatus.
Figure 3:
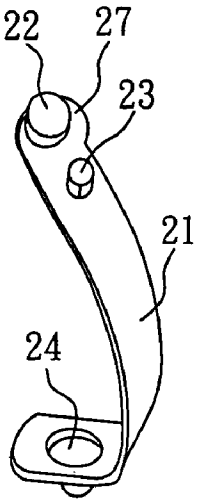
FIG. 3 is a schematic illustration showing a pictorial view of the dustproof cover of FIG. 2.
Figure 2:
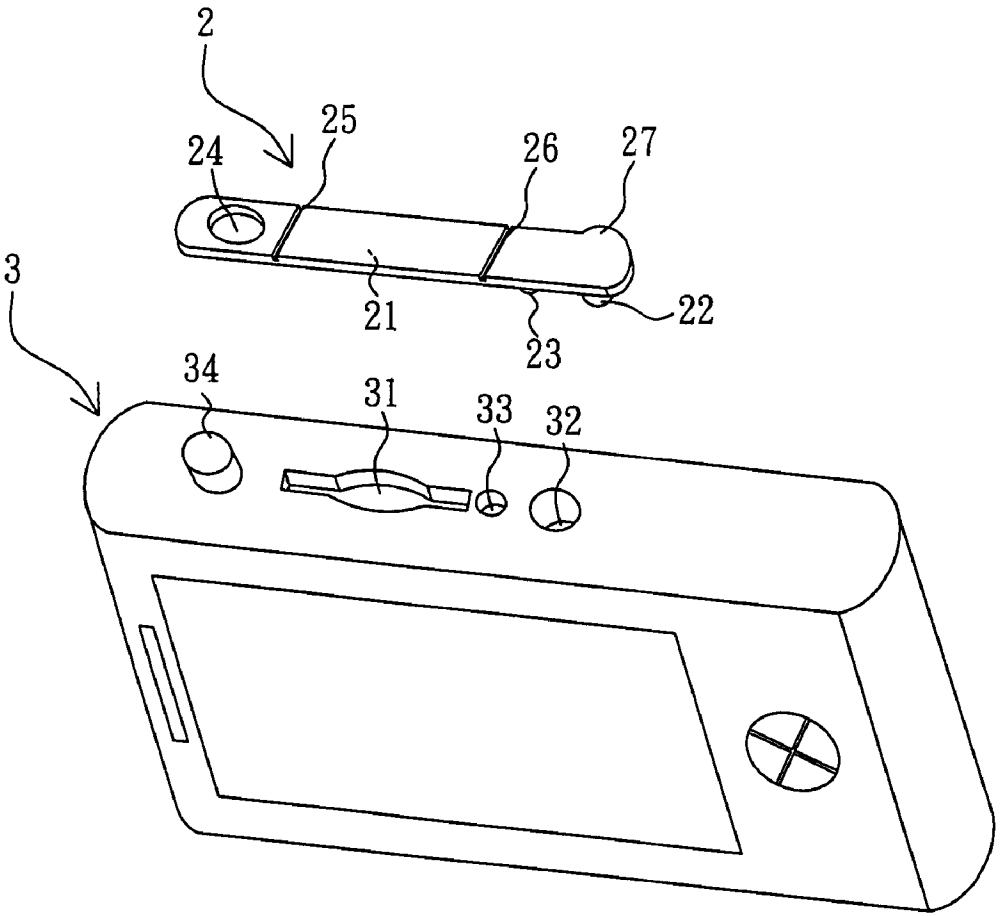
FIG. 2 is a schematic illustration showing a partially exploded view of a dustproof cover and a casing according to a preferred embodiment of the invention.

As shown in FIGS. 2 and 3, a dustproof cover 2 according to a preferred embodiment of the invention is used in conjunction with a casing 3, which at least has a first opening 31, a second opening 32, a first engaging part 33 and a first connecting part 34. The dustproof cover 2 includes a first dustproof part 21, a second dustproof part 22, a second engaging part 23 and a second connecting part 24.

The first dustproof part 21 corresponds to the first opening 31 of the casing 3, and the second dustproof part 22 corresponds to the second opening 32 of the casing 3. The first dustproof part 21 can cover the first opening 31 of the casing 3, or the first dustproof part 21 may be opened to expose the first opening 31 of the casing 3. Similarly, the second dustproof part 22 can also cover the second opening 32 of the casing 3, or the first dustproof part 21 can be opened to expose the second opening 32 of the casing 3. In addition, the shapes of the first dustproof part 21 and the second dustproof part 22 may be correspondingly designed according to the actual condition so as to reduce the cost or facilitate the use, for example. Of course, the shapes of the first dustproof part 21 and the second dustproof part 22 may also correspond to the shapes of the first opening 31 and the second opening 32 of the casing 3. In this embodiment, for example, the second opening 32 of the casing 3 has a circular and depressed shape, and the second dustproof part 22 has a circular and protruding shape. Thus, the second dustproof part 22 can completely cover the second opening 32 of the casing 3 and cannot be easily separated from the second opening 32. In addition, the first dustproof part 21 does not have a protrusion corresponding to the first opening 31 of the casing 3 such that the material and cost can be saved.

The second engaging part 23 corresponds to the first engaging part 33 of the casing 3. The second engaging part 23 may be engaged with or separated from the first engaging part 33 of the casing 3. In addition, the first engaging part 33 and the second engaging part 23 may have different designs according to the actual condition. In this embodiment, the first engaging part 33 has a slightly circular and depressed shape, and the second engaging part 23 has a slightly circular and protruding shape. Furthermore, the second engaging part 23 is located between the first dustproof part 21 and the second dustproof part 22. The second engaging part 23 may form an angle (not shown) with each of the first dustproof part 21 and the second dustproof part 22. Of course, the second dustproof part 22, the second engaging part 23 and the first dustproof part 21 may also be arranged in order. In this embodiment, the second dustproof part 22, the second engaging part 23 and the first dustproof part 21 are arranged in order, as shown in FIG. 2.

The second connecting part 24 is connected with the first connecting part 34 of the casing 3. Of course, the second connecting part 24 and the first connecting part 34 of the casing 3 may engage with each other, lock with each other, be pivoted together, be fixed together, or be clamped together according to the actual product design. In this embodiment, the first connecting part 34 of the casing 3 is a pivot and the second connecting part 24 is a fitting opening. In this instance, the second connecting part 24 is pivoted on the first connecting part 34 of the casing 3 to move the dustproof cover 2 relative to the casing 3. In addition, it is to be noted that the first connecting part 34 may also have a button function to serve as, for example, a power switch or a reset switch, and the second connecting part 24 may be an opening that fits over the first connecting part 34. In this case, the first connecting part 34 may pass through the second connecting part 24 to connect the casing 3 with the dustproof cover 2 and to expose the first connecting part 34 so as to provide the button function.

Furthermore, the first dustproof part 21 is located between the second engaging part 23 and the second connecting part 24. The first dustproof part 21 may form an angle (not shown) with each of the second engaging part 23 and the second connecting part 24. Of course, the second engaging part 23, the first dustproof part 21 and the second connecting part 24 may also be arranged in order. In this embodiment, the second engaging part 23, the first dustproof part 21 and the second connecting part 24 may also be arranged in order, as shown in FIG. 2.

In addition, the dustproof cover 2 may be made of a hard material or a flexible material. In this embodiment, the dustproof cover 2 is made of a flexible material, such as rubber or plastic material. In addition, the first dustproof part 21, the second dustproof part 22, the second engaging part 23 and the second connecting part 24 of the dustproof cover 2 may also be integrally formed into a unity so as to reduce the cost of the mold of the dustproof cover 2 and decrease the assembling complexity of the product.

Furthermore, the dustproof cover 2 may further include a first groove 25 and a second groove 26 according to the actual requirement. The first groove 25 is located between the first dustproof part 21 and the second connecting part 24, and the second groove 26 is located between the first dustproof part 21 and the second dustproof part 22. Thus, the first dustproof part 21 may be curved about the first groove 25 relative to the second connecting part 24. In addition, the second dustproof part 22 may be curved about the second groove 26 relative to the first dustproof part 21.

The dustproof cover 2 may further include a lifting part 27, which is disposed adjacent to the second dustproof part 22 according to the actual requirement. Thus, the user may apply an external force to the lifting part 27 to move the second dustproof part 22 away from the second opening 32 of the casing 3.

Figure 4:
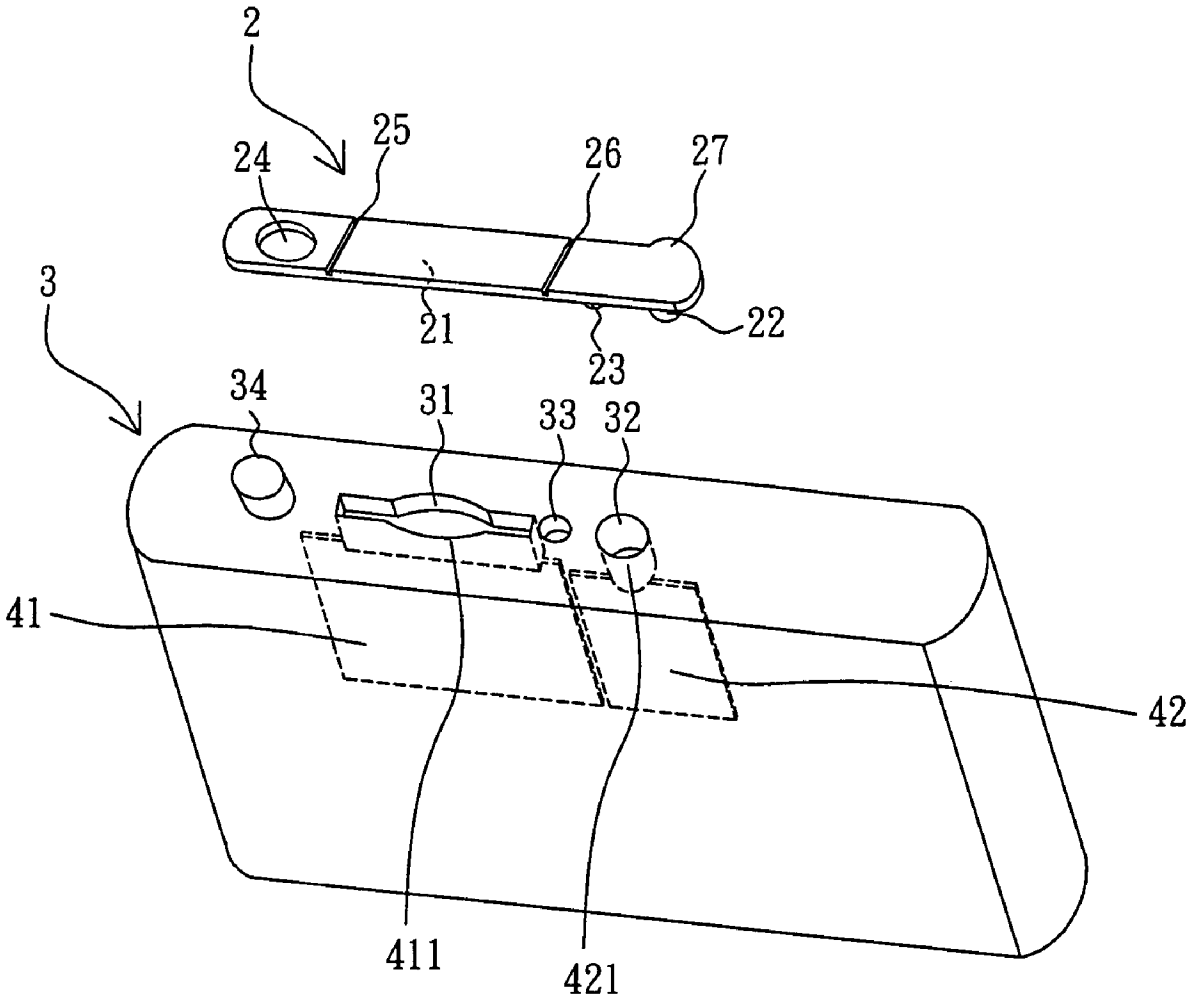
FIG. 4 is a schematic illustration showing a partial perspective view of a dustproof cover and a casing according to another preferred embodiment of the invention.

In addition, as shown in FIG. 4, the first opening 31 and the second opening 32 of the casing 3 respectively correspond to a first electronic element module 41 and a second electronic element module 42. The second electronic element module 42 or the first electronic element module 41 may be an audio card, a video card, a MS card (Memory Stick card), a USB CARD (Universal Serial Bus card) or a power switch. In this embodiment, the first electronic element module 41 is a MS card, and the second electronic element module 42 is an audio card. In addition, the first electronic element module 41 has a MS slot 411 corresponding to the first opening 31 of the casing 3 and the second electronic element module 42 has an earphone jack 421 corresponding to the second opening 32 of the casing 3.

In the above-mentioned embodiment, the dustproof cover 2 has two dustproof parts (including the first dustproof part 21 and the second dustproof part 22) respectively corresponding to two openings (including the first opening 31 and the second opening 32 of the casing 3. The dustproof cover 2 of the invention is not particularly restricted to the above-mentioned description. For example, the casing may further include a third opening and a third engaging part, and the dustproof cover may also further include a third dustproof part and a fourth engaging part. The third dustproof part corresponds to the third opening of the casing. The fourth engaging part corresponds to the third engaging part of the casing. The fourth engaging part is located between the second dustproof part and the third dustproof part (not shown).

In order to make the invention clearer, various states of the dustproof cover 2 and the casing 3 will be described in detail with reference to FIGS. 5 to 8 in conjunction with FIG. 4.

Figure 5:
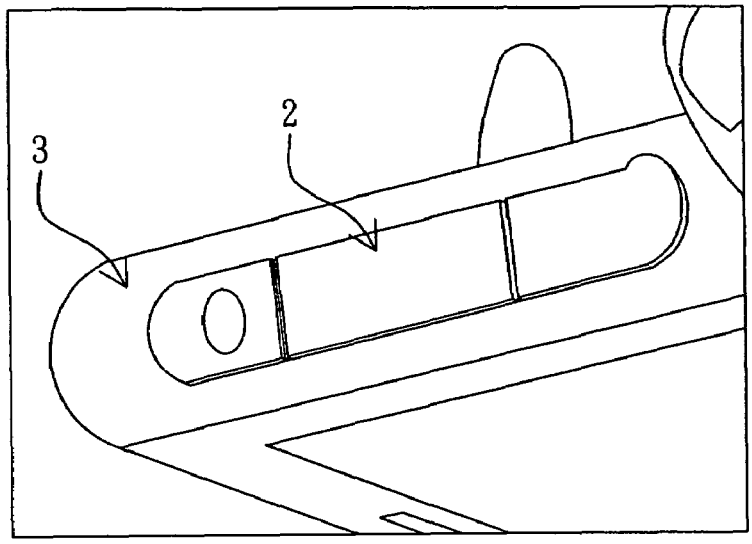
FIGS. 5 to 8 are a set of schematic illustrations showing various states of the dustproof cover and the casing according to the embodiment of the invention.

As shown in FIGS. 4 and 5, if the user does not want to use any electronic element module, the first opening 31 and the second opening 32 of the casing 3 may be in the shielded states. In other words, the first dustproof part 21 covers the first opening 31 of the casing 3, the second dustproof part 22 covers the second opening 32 of the casing 3, and the second engaging part 23 engages with the first engaging part 33 of the casing 3. in this instance, the first dustproof part 21 and the second dustproof part 22 of the dustproof cover 2 respectively protect the first electronic element module 41 (MS slot 411) and the second electronic element module 42 (earphone jack 421) corresponding to the first opening 31 and the second opening 32 of the casing 3.

Figure 6:
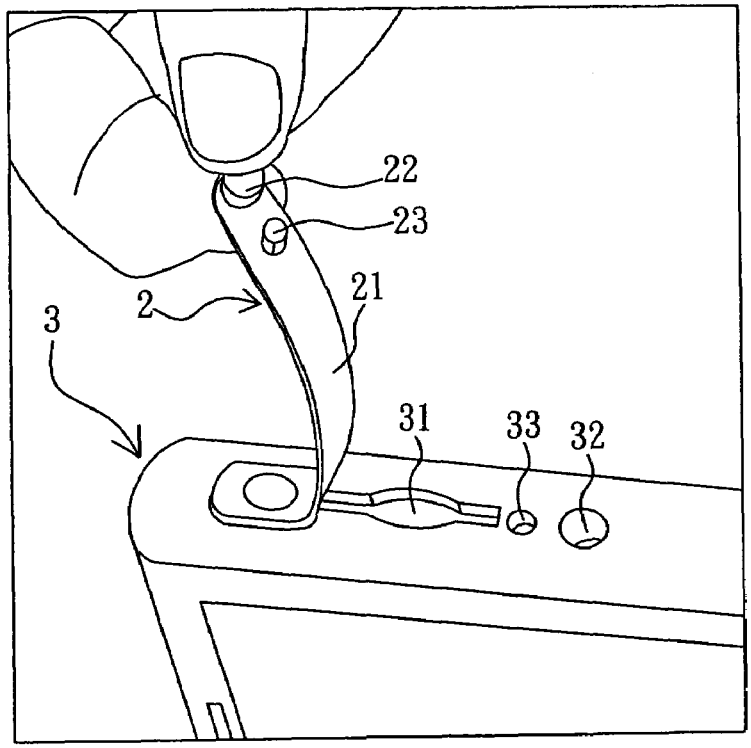

As shown in FIGS. 4 and 6, if the user needs to use the first electronic element module 41, the first opening 31 and the second opening 32 of the casing 3 may be in the exposed states. In other words, the first dustproof part 21 is opened to expose the first opening 31 of the casing 3, the second dustproof part 22 is opened to expose the second opening 32 of the casing 3, and the second engaging part 23 is separated from the first engaging part 33 of the casing 3.

Figure 7:
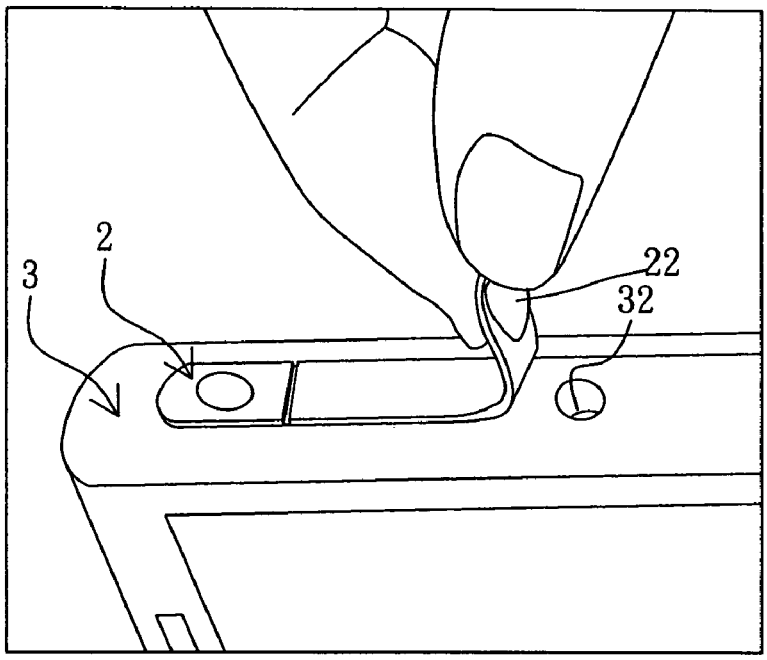
Figure 8:
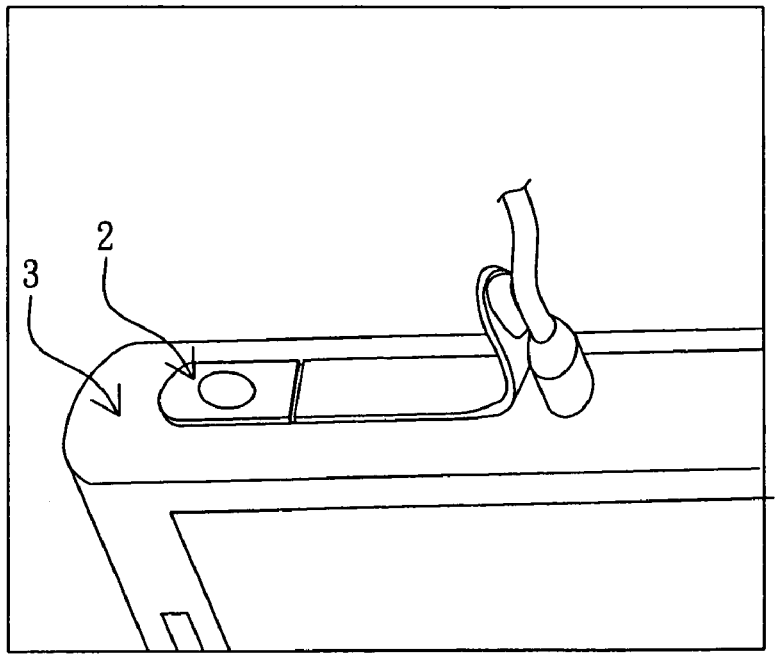

As shown in FIGS. 4 and 7, if the user needs to use the second electronic element module 42, the first opening 31 of the casing 3 may be in the shielded state and the second opening 32 of the casing 3 may be in the exposed state. In other words, the first dustproof part 21 covers the first opening 31 of the casing 3, the second dustproof part 22 is opened to expose the second opening 32 of the casing 3, and the second engaging part 23 engages with the first engaging part 33 of the casing 3. In this instance, the first dustproof part 21 of the dustproof cover 2 protects the first electronic element module 41 (MS slot 411) corresponding to the first opening 31 of the casing 3 and the second electronic element module 42 (earphone jack 421) is being used by the user, as shown in FIGS. 4 and 8. Thus, as mentioned hereinabove, when the user is not using any electronic element module, the dustproof cover 2 can simultaneously protect the first electronic element module 41 and the second electronic element module 42 corresponding to the first opening 31 of the casing 3 and the second opening 32. In addition, when the user uses the second electronic element module 42 corresponding to the second opening 32 of the casing 3, the dustproof cover 2 may also protect the first electronic element module 41 corresponding to the first opening 31 of the casing 3 so as to extend the lifetime of the electronic product.

Figure 9:
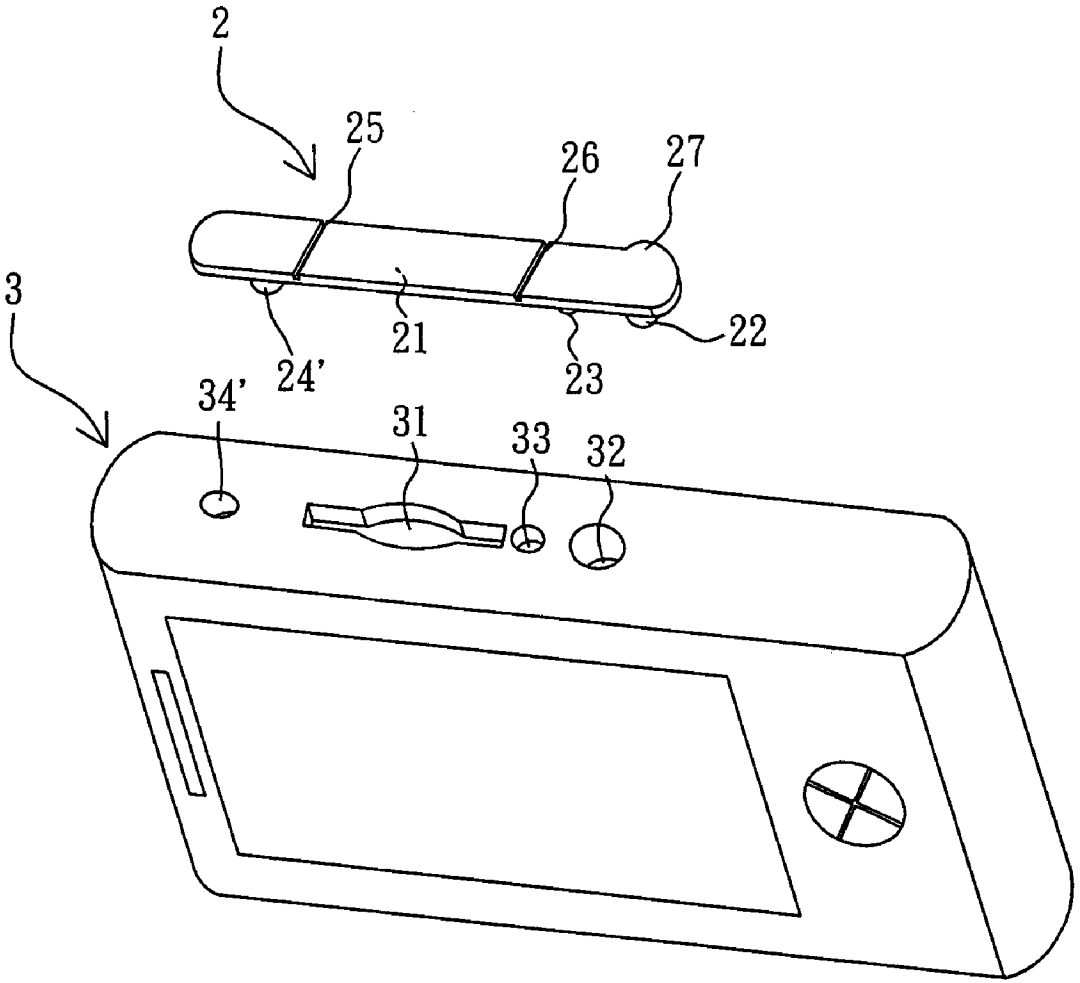
FIG. 9 is a schematic illustration showing a partially exploded view of a dustproof cover and a casing according to another preferred embodiment of the invention.

In addition, it is to be noted that the dustproof cover 2 according to the preferred embodiment of the invention uses the first connecting part 34 of the casing 3 as a pivot and the second connecting part 24 as a fitting opening to illustrate that the second connecting part 24 and the first connecting part 34 of the casing 3 may engage with each other, lock with each other, pivot to each other, be pivoted together, be fixed together, or be clamped together. Of course, the designs of and the connection between the first connecting part 34 and the second connecting part 24 may have other aspects. For example, as shown in FIG. 9, the first connecting part 34' may be a concave part and the second connecting part 24' may be a convex part. At this time, the second connecting part 24' may be connected to the first connecting part 34' of the casing 3, and may also enable the dustproof cover 2 to rotate relative to the casing 3.

Figure 10:
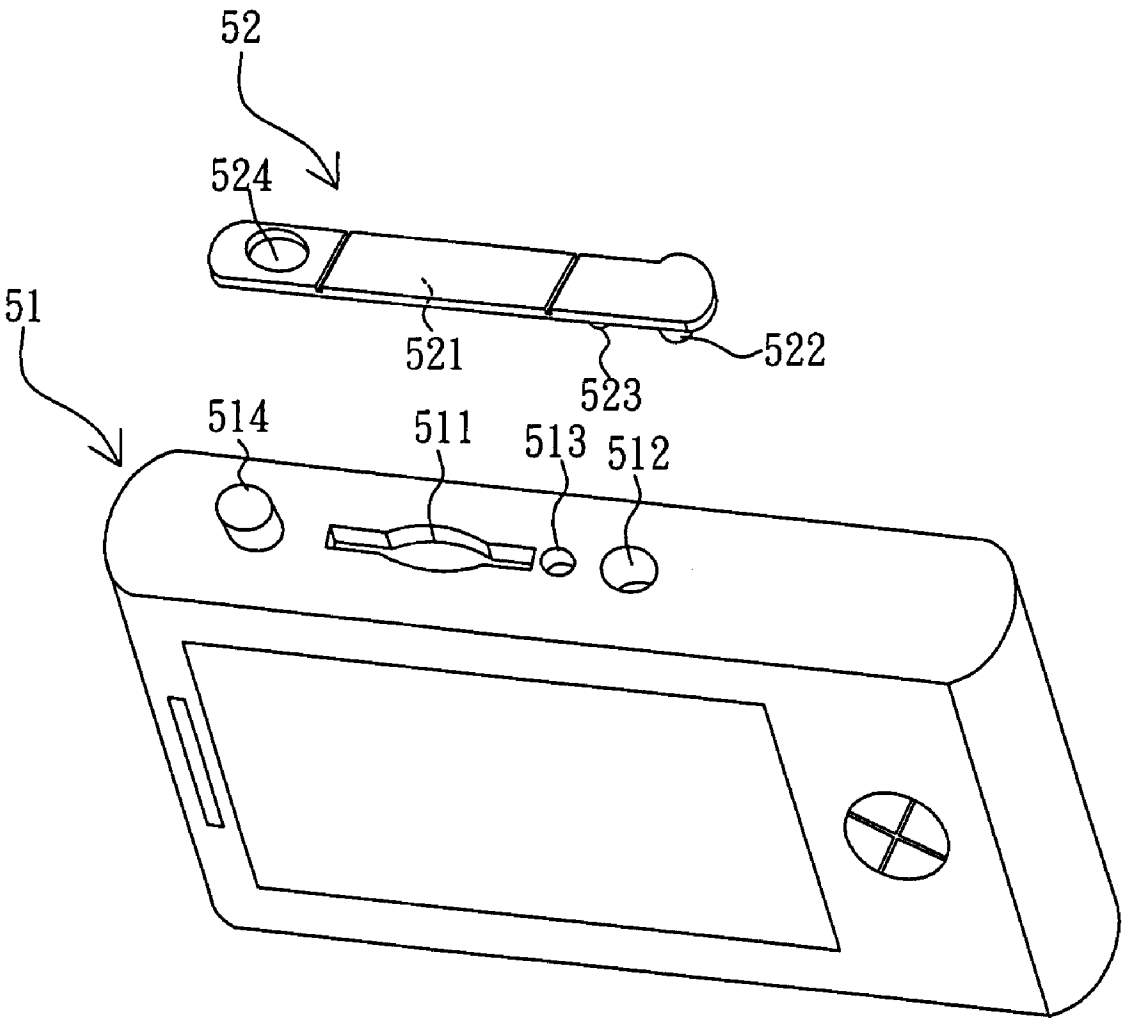
FIG. 10 is a schematic illustration showing a partially exploded view of an electronic apparatus according to still another preferred embodiment of the invention.

As shown in FIG. 10, an electronic apparatus 5 according to the preferred embodiment of the invention includes a casing 51 and a dustproof cover 52. The casing 51 at least has a first opening 511, a second opening 512, a first engaging part 513 and a first connecting part 514. The dustproof cover 52 includes a first dustproof part 521, a second dustproof part 522, a second engaging part 523 and a second connecting part 524. The first dustproof part 521 corresponds to the first opening 511 of the casing 51, the second dustproof part 522 corresponds to the second opening 512 of the casing 51, and the second engaging part 523 corresponds to the first engaging part 513 of the casing 51. The second engaging part 523 is located between the first dustproof part 521 and the second dustproof part 522. The second connecting part 524 is connected to the first connecting part 514 of the casing 51. The first dustproof part 521 is located between the second engaging part 523 and the second connecting part 524. The architectures of the casing 51 and the dustproof cover 52 are the same as those of the dustproof cover 2 and the casing 3 and have been discussed in the embodiments of FIGS. 2 to 9. So, detailed descriptions of the electronic apparatus 5 of this embodiment will be omitted.

In summary, the dustproof cover and the electronic apparatus of the invention each have the first engaging part corresponding to the second engaging part of the casing. So, when the second engaging part engages with the first engaging part of the casing, the first dustproof part and the second dustproof part may respectively cover the first opening and the second opening of the casing, or the first dustproof part can cover the first opening of the casing, and the second dustproof part can be opened to expose the second opening of the casing. In other words, the dustproof cover of the invention may keep the first opening and the second opening shielded, or keep the first opening shielded and leave the second opening exposed. Thus, when the user does not use any electronic element modules, the dustproof cover can simultaneously protect the first opening of the casing corresponding to the first electronic element module and the second electronic element module corresponding to the second opening. In addition, when the user uses the second electronic element module corresponding to the second opening of the casing, the dustproof cover may also protect the first electronic element module corresponding to the first opening of the casing and thus extend the lifetime of the electronic product.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A dustproof cover used in conjunction with a casing, which at least has a first opening, a second opening, a first engaging part and a first connecting part, the dustproof cover comprising:

a first dustproof part corresponding to the first opening of the casing;

a second dustproof part corresponding to the second opening of the casing;

a second engaging part, which corresponds to the first engaging part of the casing, and is located between the first dustproof part and the second dustproof part; and a second connecting part connected with the first connecting part of the casing, wherein the first dustproof part is located between the second engaging part and the second connecting part, wherein when the first opening is in a shielded state and the second opening is in an exposed state, the first dustproof part covers the first opening of the casing, the second dustproof part is opened to expose the second opening of the casing, and the second engaging part engages with the first engaging part of the casing, and wherein the first opening and the second opening respectively correspond to a first electronic element module and a second electronic element module.

2. The dustproof cover according to claim 1, wherein the first connecting part is a button.

3. An electronic apparatus, comprising:

a casing, which at least has a first opening, a second opening, a first engaging part and a first connecting part; and a dustproof cover, which comprises:

a first dustproof part corresponding to the first opening of the casing, a second dustproof part corresponding to the second opening of the casing, a second engaging part, which corresponds to the first engaging part of the casing and is located between the first dustproof part and the second dustproof part, and a second connecting part connected to the first connecting part of the casing, wherein the first dustproof part is located between the second engaging part and the second connecting part, wherein when the first opening is in a shielded state and the second opening is in an exposed state, the first dustproof part covers the first opening of the casing, the second dustproof part is opened to expose the second opening of the casing, and the second engaging part engages with the first engaging part of the casing.

4. The electronic apparatus according to claim 3, wherein the first connecting part is a button.

5. The electronic apparatus according to claim 3, further comprising:

a first electronic element module, which is corresponding to the first opening of the casing; and a second electronic element module, which is corresponding to the second opening of the casing.

* * * * *